US006928845B2

(12) United States Patent
Howard

(10) Patent No.: US 6,928,845 B2
(45) Date of Patent: Aug. 16, 2005

(54) KEY CAP

(76) Inventor: Raymond W. Howard, 1133 First St., #319, Coronado, CA (US) 92118-1479

( * ) Notice: Subject to any disclaimer, the term of this patent is extended or adjusted under 35 U.S.C. 154(b) by 0 days.

(21) Appl. No.: 10/299,272

(22) Filed: Nov. 18, 2002

(65) Prior Publication Data

US 2004/0093920 A1 May 20, 2004

(51) Int. Cl.[7] ..... E05B 19/04

(52) U.S. Cl. ..... 70/408; 70/395; 70/456 R; 70/460; D3/207

(58) Field of Search ..... 70/408, 456 R, 70/460, 432, 395; D3/207, 211; 24/3.6; 206/37.1, 38.1; 40/330

(56) References Cited

U.S. PATENT DOCUMENTS 1,837,114 A * 12/1931 Cicourel ..... 70/408
1,966,550 A * 7/1934 Handy ..... 250/465.1
2,982,041 A * 5/1961 Kent ..... 40/330
3,349,589 A * 10/1967 Fricke ..... 70/395
3,841,120 A * 10/1974 Gartner ..... 70/395
4,102,166 A * 7/1978 Hughes ..... 70/456 R
D252,732 S * 8/1979 Price ..... D8/7
4,305,267 A * 12/1981 Nish et al. ..... 70/395
4,403,487 A * 9/1983 Marty ..... 70/408
D293,549 S * 1/1988 Stinson ..... D8/347
4,901,548 A * 2/1990 Deslandes ..... 70/408
5,029,459 A * 7/1991 Almblad ..... 70/395
5,038,590 A * 8/1991 Sawyer et al. ..... 70/458
5,181,605 A * 1/1993 Bishop et al. ..... 206/37.1
5,435,160 A * 7/1995 Linsalato et al. ..... 70/408
5,577,403 A * 11/1996 Steeley ..... 70/456 R
5,730,013 A * 3/1998 Huang ..... 70/395
5,775,148 A * 7/1998 Layton et al. ..... 70/408
5,819,564 A * 10/1998 Watanuki ..... 70/278.2
6,233,987 B1 * 5/2001 Ueno et al. ..... 70/408
6,308,542 B1 * 10/2001 Bolton ..... 70/408
6,367,298 B1 * 4/2002 Janssen et al. ..... 70/278.3
6,609,402 B2 * 8/2003 Blankenship et al. ..... 70/408

OTHER PUBLICATIONS

LVSales, Inc. website (www.lvsales.com), "The House Key", pp. 1–3, 1997–2001.*

* cited by examiner

*Primary Examiner*—Suzanne Dino Barrett
(74) *Attorney, Agent, or Firm*—Gordon & Rees LLP; Hani Z. Sayed

(57) ABSTRACT

A universal key cap for receiving the head of a key, where the key includes a key head portion with edged segments and an extending shank portion, including a pair of spaced-apart planar walls in close proximity to each other for developing a tight frictional fit against the key head portion, wherein the pair of spaced-apart planar walls includes an inner and an outer surface and an outer periphery which are joined together by a rind for providing a full cover over the key head, the rind having an inner and outer surface; wherein the cap forms a slot at the bottom of the cap between the walls into which the key head can be inserted, a hollow chamber formed between the pair of spaced-apart planar walls and the rind for providing sufficient internal volume to receive the head portion of the key in close confronting relationship therewith, and edged segments molded on the inner surface of the rind wherein the edged segments register with at least one of the edged segments of the key head portion.

26 Claims, 6 Drawing Sheets

KW1

KW1

SC1

SC1

WR5

WR5

KW10

KW10

KEY CAP

BACKGROUND OF THE INVENTION

1. Field of the Invention

This invention relates to the field of key caps. More particularly, the invention pertains to a key cap to comfortably fit around the different edged heads of various common house keys.

2. Description of the Prior Art

Today, most people carry keys with them, e.g., house keys, vehicle keys, mail box keys, office keys. People may also, absentmindedly, carry outdated keys that have no function anymore. They carry duplicate keys of close relatives and friends for emergency situations. Thus, some people carry a plurality of keys at any given time where these keys are bound with a key ring or other retaining means. They do not want to waste time looking or identifying a specific key among the many different keys on a key ring. Therefore, rapid identification of various keys is required.

Of all the various types of keys, the house key is predominantly the most used key as everyone has a place to live and needs to secure or unlock his or her home. There are at least four common house keys being used in America today. These four common house keys differ in the shape and sizes in the key head portions where each has distinctively edged key heads. In the key industry, these keys are individually identified based on the different shape and sizes of the key head portions of these common house keys. They are: the KW1 key, the SC1 key, the WR5 key, and the KW10 key. The KW10 key is a newly introduced house key.

Prior art key caps are limited in their use with these house keys. Firstly, they do not fit around the wider keys, including the SC1 and the KW10 key heads which have obvious wide lateral sides. Therefore, the prior caps cannot be used if the user happens to own any such keys.

More significantly, however, the prior art key caps do not to fit well over the different edged key heads of the different house keys. Consequently, when the cap is placed over some of the key heads, the inner surface of the cap gets grossly distorted by the various curves and corners of the house keys and the cap bulges out. As a result, this bulging causes an unusual amount of stretching of the cap and the resulting stress of the surface areas causes tearing of the cap. Additionally, because of the rapid tearing of the cap, the user has to replace the cap often.

The prior art key caps are limited in its use because they are ineffective with some of the common house keys and with others, they cannot even be used at all. Moreover, the prior caps become distorted and stretched an exceptional amount when they are placed, or forced, over the common house keys. Additionally, the prior cap is subject to great wear and tear as a result and needs to be replaced quite often.

SUMMARY OF THE INVENTION

This invention is a polymeric or plastic-based cap for covering the head portion of the most common house keys and overcomes the problems set forth above with regard to the prior art key caps. This key cap is useful specifically with the four most common keys used in America today where the common house keys each consist of a distinctive edged key head portion.

The inventive key cap is sufficiently flexible for slipping it over the head portions of the four most common house keys discussed herein. The cap comprises two closely spaced-apart planar walls where the walls include an inner surface and outer surface, and an outer periphery which has a top edge and a pair of side edges. The top edge and side edges of the walls are monolithically joined together by a rind to form a complete cover over the key head portion. A hollow chamber is formed on the inside of the walls and the rind. The inventive cap includes a slot located at the bottom of the cap between the walls into which the head portion of the four most common house keys may be inserted. The invention lies in the internal make-up of the hollow chamber to accept the varied geometry of the head portions of the keys.

The cap of this invention is made wide enough to house the widest of the four house keys, such as the KW10 and the SC1 key head portions, without compromising a desired small appearance.

The cap of this invention would cut costs to the consumer because it fits all four of the most common house keys comfortably and does not get distorted or stretched around the segments and as a result, the wear and tear is greatly reduced. Thus, a consumer need not replace the key cap as often.

Accordingly, the main object of this invention is a key cap which is able to house all four of the most common house keys without distorting the cap. Other objects of the invention include a cap which is durable and resists wear and tear and a cap that is large enough to comfortably house larger key heads.

These and other objects of the invention will become more apparent when reading the description of the preferred embodiment along with the drawings that are appended hereto. The protection sought by the inventor may be gleaned from a fair reading of the claims that conclude the specification.

DESCRIPTION OF THE PREFERRED EMBODIMENT

Figure 1A:
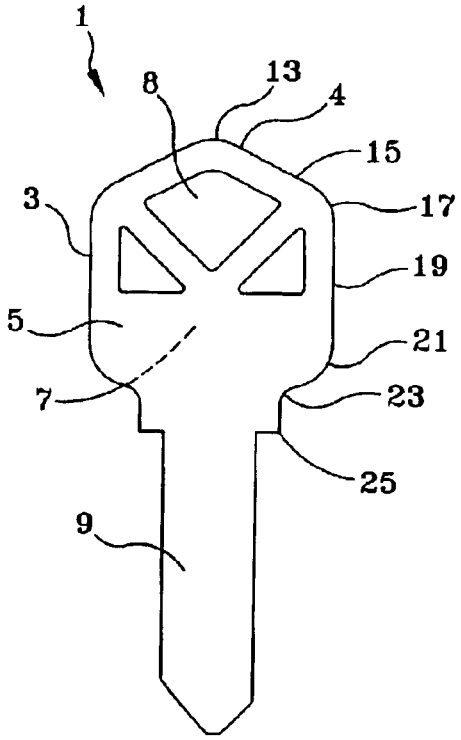
FIG. 1*a* is an elevational front view of a KW1 house key.
Figure 1B:
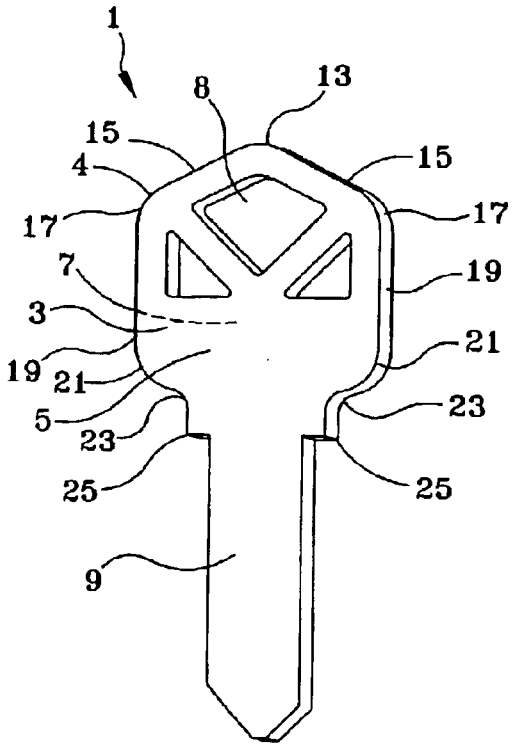
FIG. 1*b* is a perspective view of a KW1 house key.

Turning now to the drawings where elements or limitations are identified with numbers and like elements or limitations are identified with like numbers throughout the 18 figures, FIGS. 1*a*–1*h* show the four different types of house keys to which this invention is applicable. Shown in FIGS. 1*a* and 1*b* is a KW1 house key 1 that includes a head portion 3 for grasping key 1 by the fingers, where head portion 3 has edged segments 4, a broad front surface 5 and rear surface 7, preferably parallel, and having an aperture 8 therethrough, and an outwardly extending key shank portion 9, for insertion into a lock. In viewing key 1 with head portion 3 at the top and shank portion 9 extending downward therefrom, head portion 3 comprises a central convex edged segment 13, a pair of outwardly and downwardly directed straight edged segments 15 extending from convex segment 13, terminated by a pair of spaced-apart rounded corners 17, a pair of downwardly directed side edges 19 extending from corners 17, terminating in another pair of spaced-apart rounded corners 21, and a pair of inwardly directed curved edges 23 that terminates in sharp corners 25 at or above the upper end of shank portion 9.

Figure 1C:
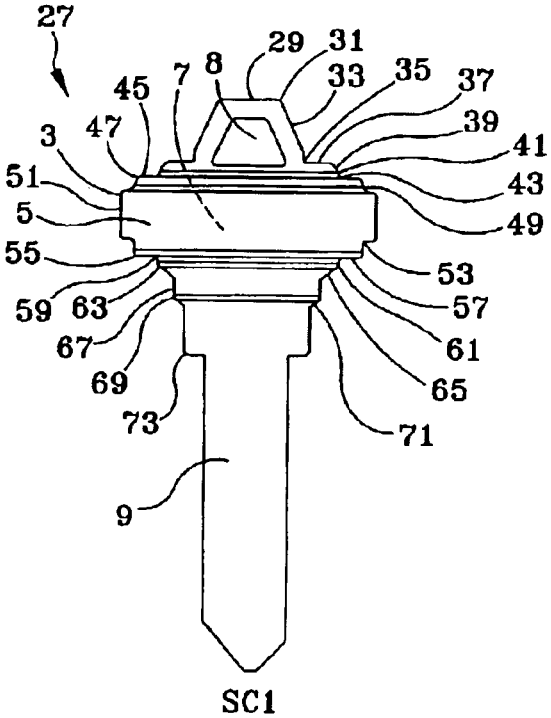
FIG. 1*c* is an elevational front view of a SC1 house key.
Figure 1D:
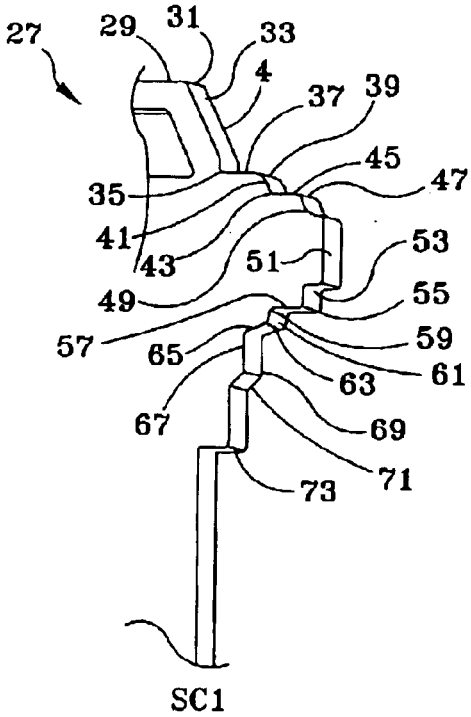
FIG. 1*d* is perspective view of a partial SC1 house key.

Shown in FIGS. 1*c* and 1*d*, is a SC1 house key 27 that includes a head portion 3 with edged segments 4, a broad front surface 5 and rear surface 7, preferably parallel, and having an aperture 8 therethrough, and an outwardly extending key shank portion 9. FIG. 1*d* depicts only a partial SC1 house key 27, showing only one side of the key, the other side (not shown) having the exact shape as the shown portion. In viewing key 27 with head portion 9 at the top and shank portion 9 extending downward therefrom, head portion 3 comprises a top central horizontal segment 29, terminating on both ends in a pair of spaced-apart arched corners 31, a pair of outwardly and downwardly directed straight edges 33 extending from corners 31, terminating in a pair of inwardly curved indentations 35, a first pair of outwardly directed horizontal edges 37 extending from indentations 35, into a first pair of outwardly edged corners 39, a pair of outwardly and downwardly directed straight segments 41 extending from corners 39, terminating in a pair of inwardly curved corners 43, and a second pair of outwardly directed horizontal edges 45 extending from curved corners 43 and terminating in a second pair of outwardly edged corners 47. A pair of concavely indentations 49 extending from corners 47 into a pair of substantially long downwardly directed side edges 51 and terminates by another pair of concavely indentations 53. A third pair of outwardly edged corners 55 extends from concavely indentations 53 into a pair of inwardly directed horizontal segments 57, terminating in a pair of inwardly arched corners 59, and a pair of substantially short downwardly descending side edges 61 extending from corners 59 and terminating by a fourth pair of outwardly edged corners 63. A pair of concave segments 65 extending into a pair of downwardly directed straight segments 67, terminating in a pair of outwardly curved segments 69, extending into a pair of inwardly directed straight segments 71, and terminating in a pair of rounded corners 73 at or above the upper end of shank portion 9.

Figure 1E:
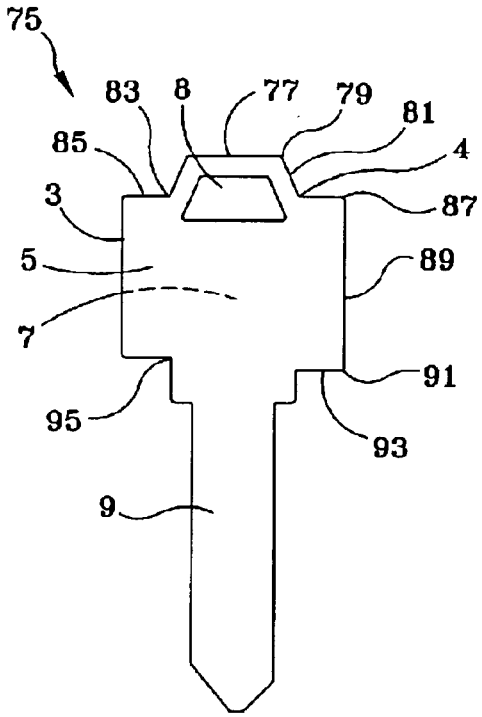
FIG. 1*e* is an elevational front view of a WR5 house key.
Figure 1F:
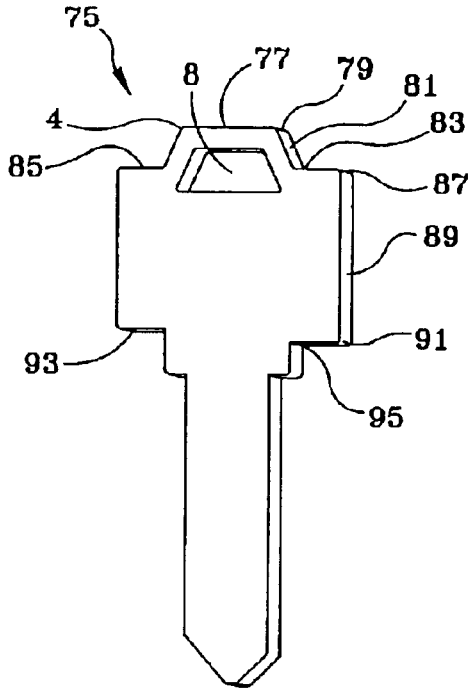
FIG. 1*f* is perspective view of a WR5 house key.

Shown in FIGS. 1*e* and 1*f*, is a WR5 house key 75 that includes a head portion 9 with edged segments 4, a broad front surface 5 and rear surface 7, preferably parallel, and having an aperture 8 therethrough, and an outwardly extending key shank portion 9. In viewing key 75 with head portion 3 at the top and shank portion 9 extending downward therefrom, head portion 75 comprises a central horizontal segment 77, terminating at both ends in a pair of spaced-apart arched corners 79, a pair of outwardly directed straight edges 81 extending from corners 79, terminating by a pair of inwardly directed sharp corners 83, a pair of horizontal segments 85 extending outwardly from corners 83 into a pair of rounded corners 87, a pair of substantially long downwardly descending edges 89 extending from rounded corners 87, terminating in a pair of outwardly rounded corners 91, a pair of horizontal inwardly directed segments 93 terminating in sharp corners 95 at or above the upper end of shank portion 9.

Figure 1G:
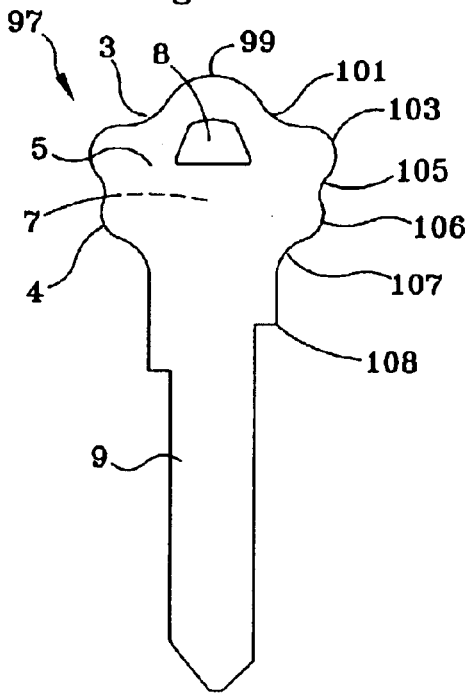
FIG. 1*g* is an elevational front view of a KW10 house key.
Figure 1H:
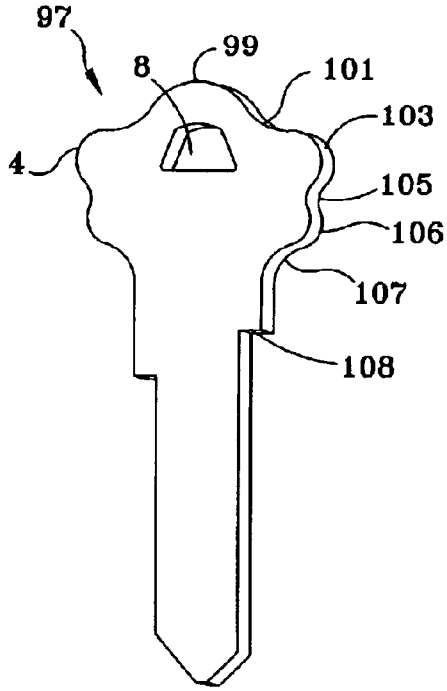
FIG. 1*h* is a perspective view of a KW10 house key.

Shown in FIGS. 1*g* and 1*h* is a KW10 house key 97 that includes a head portion 3 with edged segments 4, a broad front surface 5 and rear surface 7, preferably parallel, and having an aperture 8 therethrough, and an outwardly extending key shank portion 9. In viewing key 97 with head portion 3 at the top and shank portion 9 extending downward therefrom, head portion 3 comprises a central convex edged segment 99 extending into a pair of spaced-apart substantially large concave edged segments 101, a pair of convex segments 103 extending from concave segments 101 into a pair of inwardly curved side segments 105 extending into another pair of convex segments 106, that terminate at another pair of substantially large concave segments 107, wherein concave segments 107 terminate at a pair of sharp corners 108 at or above the upper end of shank portion 9.

Figure 2:
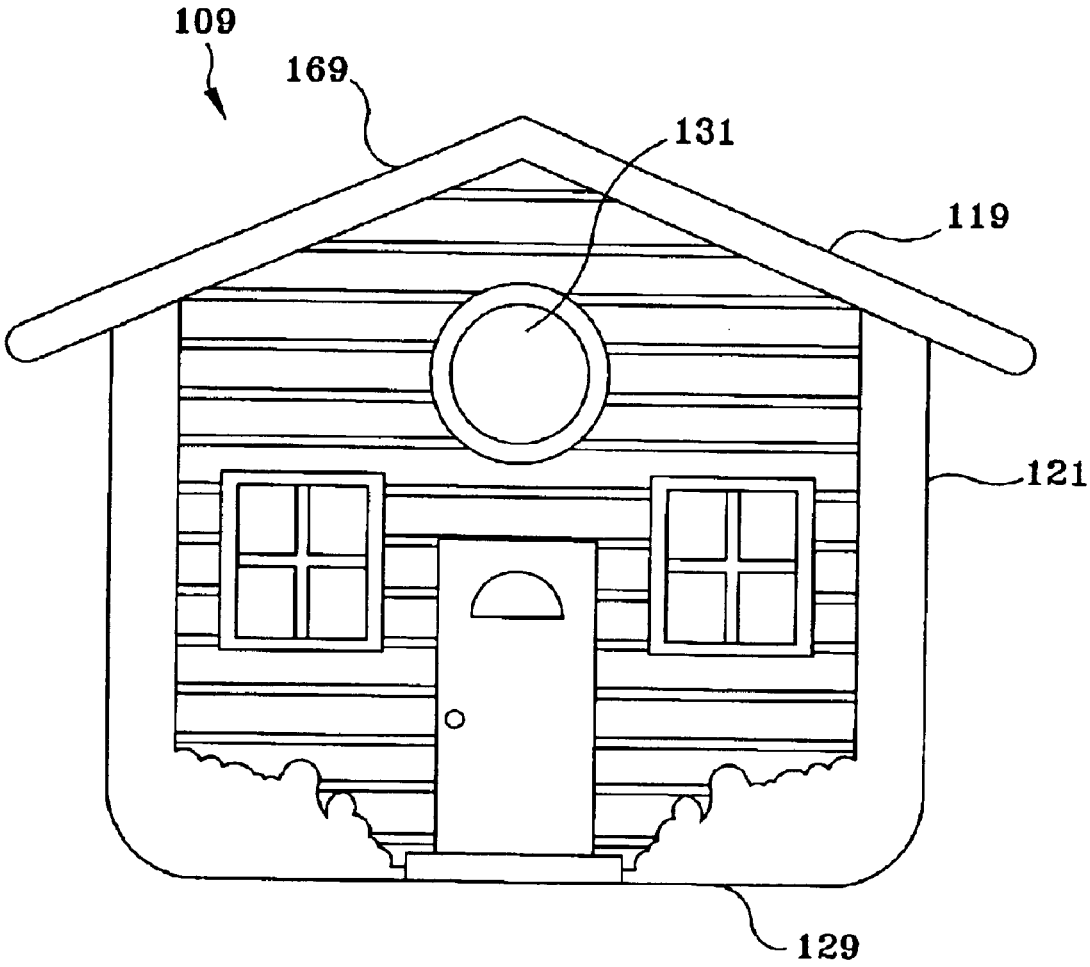
FIG. 2 is a front view of the inventive cap shaped in the periphery of a house and constructed according to the teachings of this invention.
Figure 3:
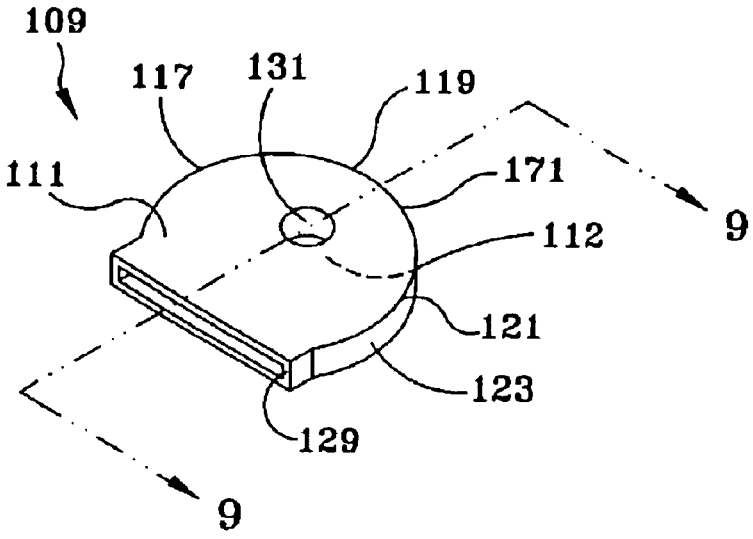
FIG. 3 is a perspective view of the inventive cap shaped in a circular periphery and constructed according to the teachings of this invention.

The preferred embodiment of the inventive key cap is shown in FIGS. 2 and 3 and shows a polymeric or plastic-based cap 109 for slipping over the head portions 3 of the four common house keys discussed herein. As shown in FIGS. 4, 5, 6, 7 and 9, the cap 109 comprises two closely spaced-apart planar walls 111 and 112 where walls 111 and 112 include an inner surface 113 and outer surface 115, an outer periphery 117 having a top edge 119 and a pair of side edges 121 which are monolithically joined together by a rind 123 to form a complete cover over key head portion 3, and a hollow chamber 125 formed on inside of walls 111 and 112 and rind 123. The inventive cap includes a slot 127 located at the bottom 129 of cap 109 between walls 111 and 112 into which head portion 3 of the four most common house keys may be inserted. The invention lies in the internal make-up of hollow chamber 125 to accept the varied geometry of the head portions 3 of the keys previously disclosed herein.

Walls 111 and 112 of cap 109 are made sufficiently thin to provide substantial flexibility to allow snug ingress and egress of head portion 3 of the house keys without damaging cap 109. Outer surface 115 of walls 111 and 112 and outer surface 133 of rind 123 are smooth and printable and an indicia or design can be printed on them. Walls 111 and 112 further have aligned apertures 131 therethrough, shown in FIG. 3, which also align with aperture 8 in key head portion 3 when cap 109 is placed over key head portion 3. Aperture 131 is sufficiently wide in diameter to accommodate a retaining member such as a key ring or key chain.

Figure 7:
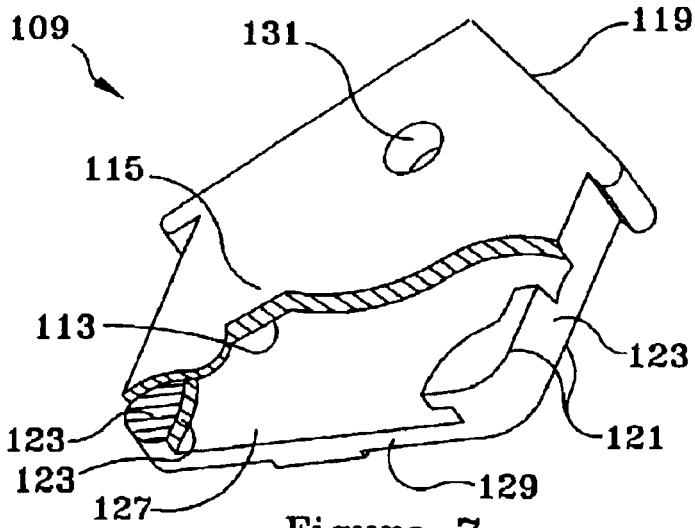
FIG. 7 is a perspective view of the cap shown in FIG. 2 showing a segment cut out from one of the walls of the cap.
Figure 8:
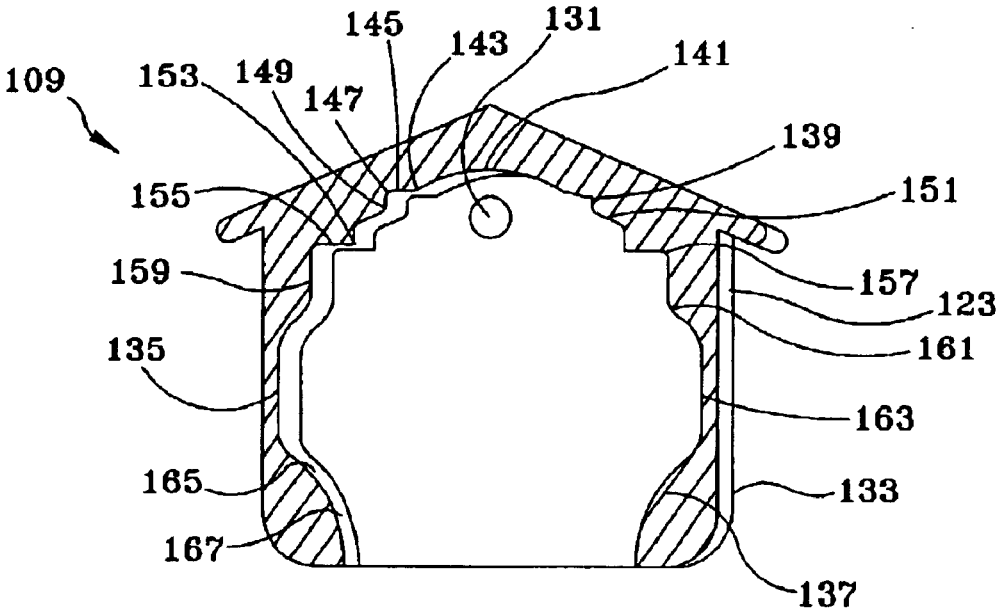
FIG. 8 is cross-sectional front view of the cap shown in FIG. 2 made according to the teachings of this inventions showing the edged segments of the inner surface of the rind.
Figure 9:
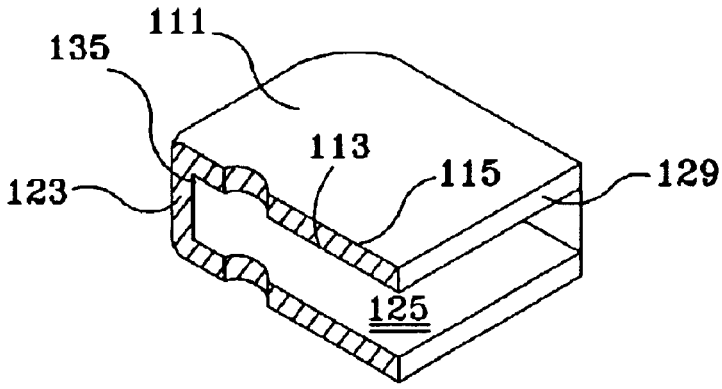
FIG. 9 is a perspective view of a sectional view of the cap taken along the lines 9—9 in FIG. 3.

As shown in FIGS. 7 and 8, rind 123 having an outer surface 133 and inner surface 135, extends toward bottom 129 of cap 109 into a pair of upsets 137 to provide resistance in the removal of the key heads. As shown in the cross-sectional side view in FIG. 8, inner surface 135 of rind 123 includes edged segments 139 that snugly fit at least around one of edged segments 4 of head portion 3 of the four most common house keys. In viewing the side cross-section of cap 109 with top edge 119 of walls 111 and 112 at the top and side edges 121 extending downward therefrom, edged segments 139 comprise a central convex edged segment 141, a pair of inwardly arched segments 143, extending from convex segment 141 into a first pair of outwardly directed horizontal segments 145, where horizontal segments 145 terminate by a pair of outwardly protruding edged corners 147. A first pair of inwardly directed edged indentations 149 extends from corners 147 into a pair of outwardly and downwardly straight edges 151, which terminates by a second pair of inwardly directed edged indentations 153. A second pair of outwardly directed horizontal segments 155 extends from indentations 153 and terminates by a pair of outwardly protruding rounded corners 157. Corners 157 extend downwardly into a pair of straight edges 159, terminated by a first pair of inwardly curved indentations 161, and a pair of substantially large side convex segments 163 extending from indentations 161 into a second pair of inwardly curved indentations 165. A pair of downwardly descending straight edges 167 extends from indentations 165 and terminates in slot 127.

When head portion 3 of KW1 key 1 (FIGS. 1*a* and 1*b*) is received by edged segments 139 of cap 109, convex edged segment 141 of cap 109 registers with convex edged segment 13 of KW1 key 1, second pair of edged indentations 153 of cap 109 presses between straight segment 15 and rounded corners 17 of KW1 key 1, and second pair of curved indentations 165 of cap 109 contacts rounded corners 21 of KW1 key 1.

When head portion 3 of SC1 key 27 (FIGS. 1*c* and 1*d*) is received by edged segments 139 of cap 109, arched segments 143 of cap 109 abut arched corners 31 of SC1 key 27, curved indentations 161 of cap 109 press against edged corners 47 of SC1 key 27, side convex segments 163 of cap 109 receive in adjacent juxtaposition side edges 51 of SC1 key 27, and curved indentations 165 of cap 109 abut edged corners 55 of SC1 key 27. Round corners 73 of SC1 key 27 align with entrance of slot 127 of cap 109.

When head portion 3 of WR5 key 75 (FIGS. 1*e* and 1*f*) is received by edged segments 139 of cap 109, horizontal segments 145 of cap 109 receive horizontal segment 77 of key 75 in adjacent juxtaposition, arched corners 79 of WR5 key 75 hook into edged corners 147 of cap 109, and rounded corners 87 of key 75 hook into rounded corners 157 of cap 109. First pair of straight edges 159 and second pair of straight edges 167 of cap 109 are forced against descending edges 89 of key 75, and horizontal segments 93 of WR5 key 75 forming an alignment with slot 127.

When head portion 3 of KW10 key 97 (FIGS. 1*g* and 1*h*) is received by edged segments 139 of cap 109, central convex segment 141 of cap 109 presses against central convex segment 99 of KW10 key 97, and side convex segments 163 of cap 109 capture large convex edged segments 103 of KW10 key 97. Other convex segments 106 of key 97 press against curved indentations 165 of cap 109 and concave segments 107 of KW10 key 97 extend through slot 127 to the outside of cap 109.

Figure 4:
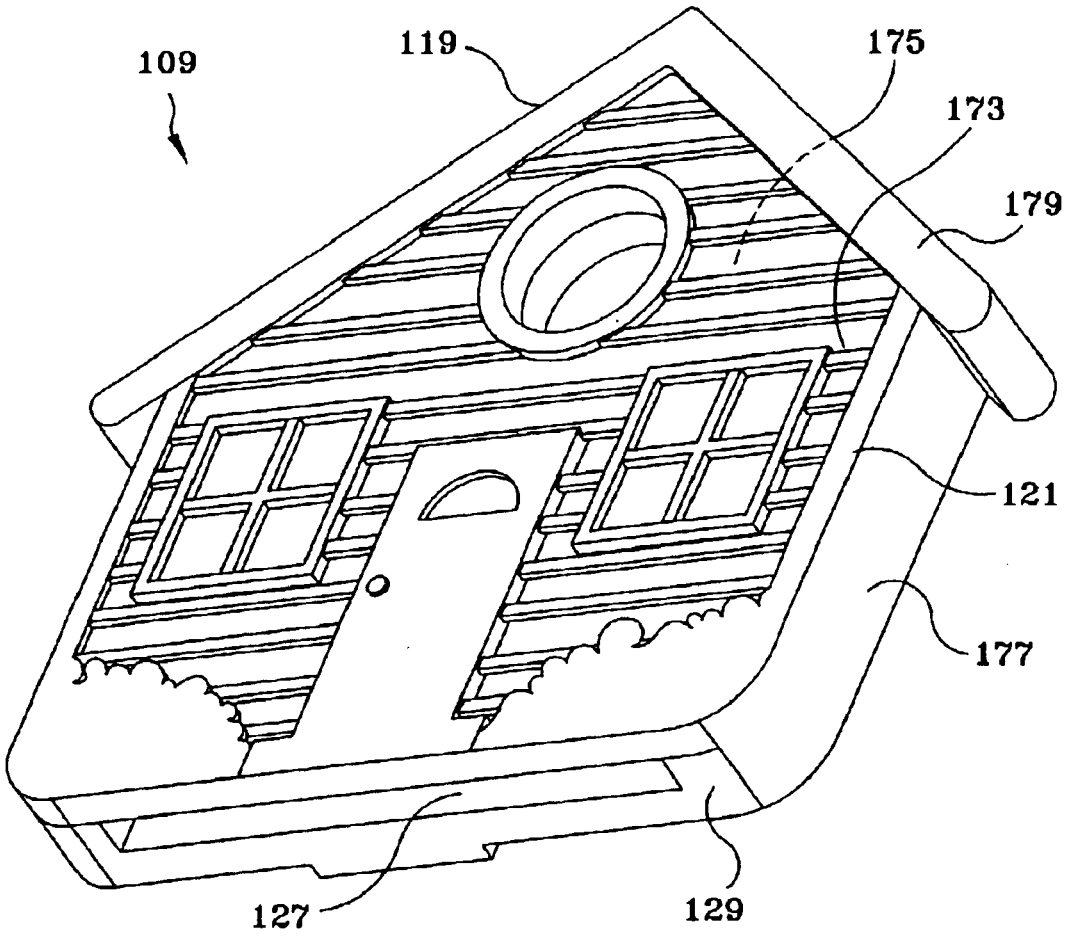
FIG. 4 is perspective view of the cap shown in FIG. 2.
Figure 5:
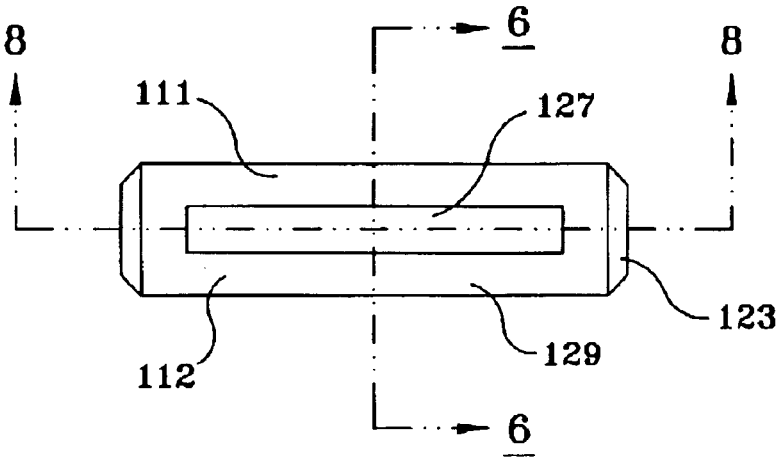
FIG. 5 is a bottom view of the cap shown in FIG. 2.
Figure 6:
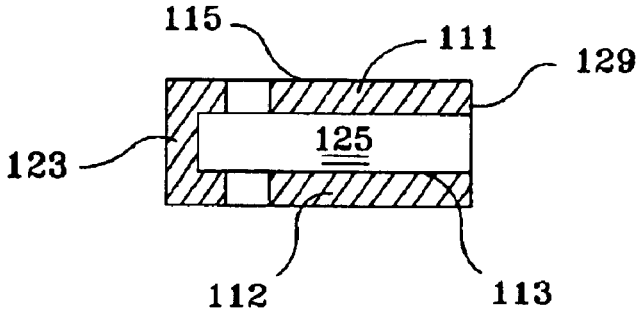
FIG. 6 is a sectional view of the cap shown in FIG. 2 taken along the lines 6—6 in FIG. 5.

To assist the user in the identification of a house key, cap 109 can be shaped in the periphery of a house 169, shown in FIGS. 2 and 4. Alternatively, cap 109 can be shaped in a circular periphery 171, shown in FIG. 3. Where cap 109 is shaped in the periphery of house 169, walls 111 and 112 represent the front wall 173 and back wall 175 of house 169, respectively. Rind 123 includes opposite longitudinal side walls 177 of house 169 and a V-shaped roof 179 of house 169.

Figure 10:
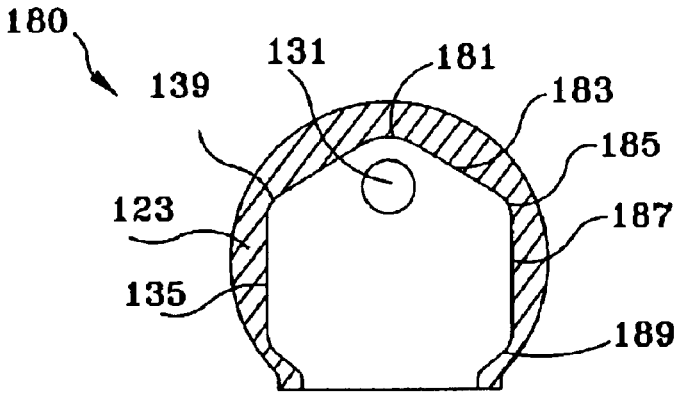
FIG. 10 is a cross-sectional side view of the KW1 key cap showing a circular outer periphery with the edged segments of the inner surface of the rind.
Figure 11:
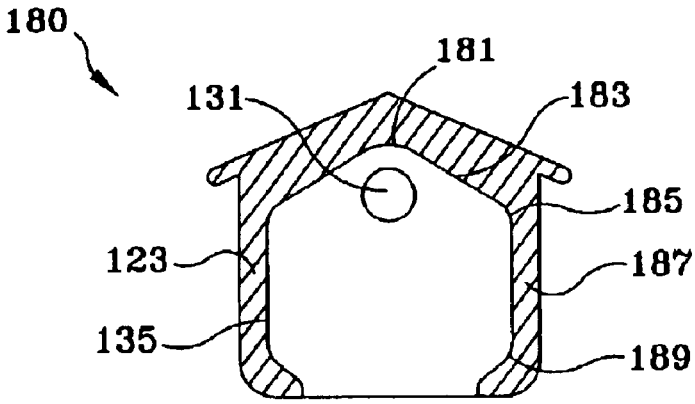
FIG. 11 is a cross-sectional side view of the KW1 key cap showing a house-shaped outer periphery with the edged segments on the inner surface of the rind.

In a modification of this invention, FIGS. 10 and 11 show a key cap 180 for housing head portion 3 of KW1 key 1 where cap 180 comprises a pair of spaced-apart planar walls 111 and 112 joined together about their outer periphery 117 by rind 123 having an inner surface 135 which include edged segments 139 that register with edged segments 4 of KW1 key 1. In viewing the side cross-section of cap 180 with top edge 119 of walls 111 and 112 at the top and side edges 121 extending downward therefrom, rind 123 comprises a central convex edged segment 181, a pair of outwardly and downwardly directed straight segments 183 extending from convex segment 181 into a first pair of rounded corners 185, a pair of straight downwardly directed edges 187 extending from corners 185, and terminated by a second pair of rounded corners 189. Second pair of rounded corners 189 terminate in slot 127. Cap 180 can be shaped in the periphery of a house or in a circular periphery.

When head portion 3 of KW1 key 1 is received by edged segments 139 of cap 180, convex segment 13 of key 1 is forced against convex segment 181 of cap 180, straight segments 183 of cap 180 abut straight edged segments 15 of key 1, rounded corners 185 of cap 180 contacts rounded corners 17 of key 1, straight edges 19 of key 1 is forced against straight edges 187 of cap 180, and another pair of rounded corners 21 of key 1 hooks into rounded corners 189 of cap 180.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A universal key cap for receiving the head of a key, where the key includes a key head portion with edged segments and an extending shank portion, comprising:

a. a pair of spaced-apart planar walls in close proximity to each other for developing a tight frictional fit against the key head portion, wherein said pair of spaced-apart planar walls includes an inner and an outer surface and an outer periphery which are joined together by a rind for providing a full cover over the key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the key in close confronting relationship therewith; and, c. edged segments molded on said inner surface of said rind wherein said edged segments register with at least one of the edged segments of the key head portion.

2. The universal key cap in claim 1 wherein said edged segments comprise:

a. a central convex edged segment which registers with the central convex edged segment of the KW1 key head and with the central convex edged segment of the KW10 key head;

b. a pair of inwardly arched segments extending outwardly from said central convex edged segment and registering with the pair of spaced-apart arched corners of the SC1 key head;

c. a first pair of outwardly directed horizontal segments extending from said pair of inwardly arched segments and registering with the central horizontal segment of the WR5 key head;

d. a pair of outwardly protruding edged corners extending from said first pair of outwardly directed horizontal segments and registering with the pair of spaced-apart arched corners of the WR5 key head;

e. a first pair of inwardly directed edged indentations extending from said pair of outwardly protruding edged corners and registering with the pair of spaced-apart arched corners of the WR5 key head;

f. a pair of outwardly and downwardly straight edges extending from said first pair of inwardly directed edged indentations and terminating by a second pair of inwardly directed edged indentations, wherein said second pair of inwardly directed edged indentations register with the KW1 key head between the pair of outwardly and downwardly directed straight edged segments and the first pair of spaced-apart rounded corners;

g. a second pair of outwardly directed horizontal segments, extending from said second pair of inwardly directed edged indentations and registering with the pair of horizontal segments of the WR5 key head;

h. a pair of outwardly protruding rounded corners extending from said second pair of outwardly directed horizontal segments and registering with the pair of rounded corners of the WR5 key head;

i. a pair of straight edges extending from said pair of outwardly protruding rounded corners and registering with the pair of substantially long downwardly descended edges of the WR5 key head;

j. a first pair of inwardly curved indentations extending from said pair of straight edges and registering with the second pair of outwardly edged corners of the SC1 key head;

k. a pair of substantially large side convex segments extending from said first pair of inwardly curved indentations and registering with the pair of substantially long downwardly directed side edges of the SC1 key head; said pair of substantially large side convex segments further registering with the first pair of convex segments of the KW10 key head;

l. a second pair of inwardly curved indentations extending from said pair of large side convex segments and registering with the third pair of outwardly edged corners of the SC1 key head; said second pair of inwardly curved indentations further registering with the second pair of spaced-apart rounded corners of the KW1 key head; and, m. a pair of downwardly descending straight edges extending from said second pair of inwardly curved indentations and registering with the pair of substantially long downwardly descending edges of the WR5 key head; said pair of downwardly descending straight edges terminating in said slot.

3. The universal key cap of claim 1 wherein said rind extends toward said bottom of said cap to form a pair of upsets within said hollow chamber for providing resistance in the removal of the key head portion.

4. The universal key cap of claim 1 wherein said planar walls have formed there through aligned apertures with a sufficiently wide diameter to accommodate a retaining member.

5. The universal key cap of claim 1 wherein said aligned apertures align with the apertures in the head portion of the keys.

6. The universal key cap of claim 1 wherein said planar walls are sufficiently thin to provide substantial flexibility to allow snug ingress and egress of the key head without damaging said cap.

7. The universal key cap of claim 1 wherein said outer surfaces of said planar walls and said rind have smooth surfaces.

8. The universal key cap of claim 1 wherein said outer surfaces of said planar walls and said rind have printable surfaces.

9. The universal key cap of claim 1 wherein said slot is rectangular.

10. The universal key cap of claim 1 wherein said cap forms a periphery in the silhouette of a house.

11. The universal key cap of claim 1 wherein said cap forms a circular periphery.

12. A key cap for receiving the head of the KW1 common house key where the KW1 common house key includes a head portion with edged segments and an extending shank portion, comprising:

a. a pair of spaced-apart planar walls in close proximity to each other for developing a tight frictional fit against the head portion of the KW1 common house key, wherein said pair of spaced-apart planar walls includes an inner and an outer surface and an outer periphery which are joined together by a rind for providing a full cover over the KW1 key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the KW1 key in close confronting relationship therewith; and c. edged segments molded on said inner surface of said rind wherein said edged segments register with the edged segments of the head portion of the KW1 key.

13. The key cap of claim 12 wherein said edged segments comprise:

a. a central convex edged segment which registers with the central convex edged segment of the KW1 key head;

b. a pair of outwardly and downwardly directed straight segments extending from said central convex edged segment and registering with the pair of outwardly and downwardly directed straight edged segments of the KW1 key head;

c. a first pair of rounded corners extending from said pair of outwardly and downwardly directed straight segments and registering with the pair of spaced-apart rounded corners of the KW1 key head;

d. a pair of straight downwardly directed edges extending from said first pair of rounded corners and registering with the pair of downwardly directed side edges of the KW1 key head; and e. a second pair of rounded corners extending from said pair of straight downwardly directed edges and registering with the second pair of spaced apart rounded corners of the KW1 key head, wherein said second pair of rounded corners terminate in said slot.

14. The key cap of claim 12 wherein said planar walls have formed there through aligned apertures with a sufficiently wide diameter to accommodate a retaining member.

15. The key cap of claim 12 wherein said aligned apertures align with the aperture in the KW1 key head.

16. The cap of claim 12 wherein said planar walls are sufficiently thin to provide substantial flexibility to allow snug ingress and egress of the key head without damaging said cap.

17. The key cap of claim 12 wherein said outer surfaces of said planar walls and said rind have smooth surfaces.

18. The key cap of claim 12 wherein said outer surfaces of said planar walls and said rind have printable surfaces.

19. The key cap of claim 12 wherein said slot is rectangular.

20. The key cap of claim 12 wherein said cap forms a periphery in the silhouette of a house.

21. The key cap of claim 12 wherein said cap forms a circular periphery.

22. A universal key cap for receiving the head of a key, where the key includes a key head portion with edged segments and an extending shank portion, comprising:

a. a pair of spaced-apart planar walls in close proximity to each other for developing a tight frictional fit against the key head portion, wherein said pair of spaced-apart planar walls includes an inner and an outer surface and an outer periphery which are joined together by a rind for providing a full cover over the key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the key in close confronting relationship therewith;

c. edged segments molded on said inner surface of said rind wherein said edged segments register with at least one of the edged segments of the key head portion;

d. a central convex edged segment which registers with the central convex edged segment of the KW1 key head and with the central convex edged segment of the KW10 key head;

e. a pair of inwardly arched segments extending outwardly from said central convex edged segment and registering with the pair of spaced-apart arched corners of the SC1 key head;

f. a first pair of outwardly directed horizontal segments extending from said pair of inwardly arched segments and registering with the central horizontal segment of the WR5 key head;

g. a pair of outwardly protruding edged corners extending from said first pair of outwardly directed horizontal segments and registering with the pair of spaced-apart arched corners of the WR5 key head;

h. a first pair of inwardly directed edged indentations extending from said pair of outwardly protruding edged corners and registering with the pair of spaced-apart arched corners of the WR5 key head;

i. a pair of outwardly and downwardly straight edges extending from said first pair of inwardly directed edged indentations and terminating by a second pair of inwardly directed edged indentations, wherein said second pair of inwardly directed edged indentations register with the KW1 key head between the pair of outwardly and downwardly directed straight edged segments and the first pair of spaced-apart rounded corners;

j. a second pair of outwardly directed horizontal segments, extending from said second pair of inwardly directed edged indentations and registering with the pair of horizontal segments of the WR5 key head;

k. a pair of outwardly protruding rounded corners extending from said second pair of outwardly directed horizontal segments and registering with the pair of rounded corners of the WR5 key head;

l. a pair of straight edges extending from said pair of outwardly protruding rounded corners and registering with the pair of substantially long downwardly descended edges of the WR5 key head;

m. a first pair of inwardly curved indentations extending from said pair of straight edges and registering with the second pair of outwardly edged corners of the SC1 key head;

n. a pair of substantially large side convex segments extending from said first pair of inwardly curved indentations and registering with the pair of substantially long downwardly directed side edges of the SC1 key head; said pair of substantially large side convex segments further registering with the first pair of convex segments of the KW10 key head;

o. a second pair of inwardly curved indentations extending from said pair of large side convex segments and registering with the third pair of outwardly edged corners of the SC1 key head; said second pair of inwardly curved indentations further registering with the second pair of spaced-apart rounded corners of the KW1 key head; and, p. a pair of downwardly descending straight edges extending from said second pair of inwardly curved indentations and registering with the pair of substantially long downwardly descending edges of the WR5 key head; said pair of downwardly descending straight edges terminating in said slot.

23. A universal key cap for receiving the head of a key, where the key includes a key head portion with edged segments and an extending shank portion, comprising:

a. a pair of spaced-apart planar walls in close proximity to each other for developing a tight frictional fit against the key head portion, wherein said pair of spaced-apart planar walls includes an inner and an outer surface and an outer periphery which are joined together by a rind for providing a full cover over the key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the key in close confronting relationship therewith;

c. edged segments molded on said inner surface of said rind wherein said edged segments register with at least one of the edged segments of the key head portion; and wherein said apertures align with the apertures in the head portion of the keys.

24. A key cap for receiving the head of the KW1 common house key where the KW1 common house key includes a head portion with edged segments and an extending shank portion, comprising:

a. a pair of spaced-apart planar walls in close proximity to each other for developing a tight frictional fit against the head portion of the KW1 common house key, wherein said pair of spaced-apart planar walls includes an inner and an outer surface and an outer periphery which are joined together by a rind for providing a full cover over the KW1 key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the KW1 key in close confronting relationship therewith;

c. edged segments molded on said inner surface of said rind wherein said edged segments register with the edged segments of the head portion of the KW1 key;

d. a central convex edged segment which registers with the central convex edged segment of the KW1 key head;

e. a pair of outwardly and downwardly directed straight segments extending from said central convex edged segment and registering with the pair of outwardly and downwardly directed straight edged segments of the KW1 key head;

f. a first pair of rounded corners extending from said pair of outwardly and downwardly directed straight segments and registering with the pair of spaced-apart rounded corners of the KW1 key head;

g. a pair of straight downwardly directed edges extending from said first pair of rounded corners and registering with the pair of downwardly directed side edges of the KW1 key head; and h. a second pair of rounded corners extending from said pair of straight downwardly directed edges and registering with the second pair of spaced apart rounded corners of the KW1 key head, wherein said second pair of rounded corners terminate in said slot.

25. A key cap for receiving the head of the KW1 common house key where the KW1 common house key includes a head portion with edged segments and an extending shank portion, comprising:

a. a pair of spaced-apart planar walls in close proximity to each other for developing a tight frictional fit against the head portion of the KW1 common house key, wherein said pair of spaced-apart planar walls includes an inner and an outer surface and an outer periphery which are joined together by a rind for providing a full cover over the KW1 key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the KW1 key in close confronting relationship therewith; and c. edged segments molded on said inner surface of said rind wherein said edged segments register with the edged segments of the head portion of the KW1 key; and said aligned apertures align with the aperture in the KW1 key head.

26. A key cap for receiving the head of the KW1 common house key where the KW1 common house key includes a head portion with edged segments and an extending shank portion, comprising:

a. a pair of spaced-apart planar walls in close proximity to each other for developing a tight frictional fit against the head portion of the KW1 common house key, wherein said pair of spaced-apart planar walls includes an inner and an outer surface and an outer periphery which are joined together by a rind for providing a full cover over the KW1 key head, said rind having an inner and outer surface; wherein said cap forms a slot at the bottom of said cap between said walls into which the key head can be inserted;

b. a hollow chamber formed between said pair of spaced-apart planar walls and said rind for providing sufficient internal volume to receive the head portion of the KW1 key in close confronting relationship therewith; and c. edged segments molded on said inner surface of said rind wherein said edged segments register with the edged segments of the head portion of the KW1 key; and said cap forms a circular periphery.

* * * * *